US007798665B2

(12) United States Patent
Yang

(10) Patent No.: US 7,798,665 B2
(45) Date of Patent: Sep. 21, 2010

(54) STRUCTURE OF OPTOELECTRONIC HANDHOLD

(76) Inventor: Chin-Sheng Yang, 4F., No. 26, Lane 358, Yung-An St., Tainan City (TW)

( * ) Notice: Subject to any disclaimer, the term of this patent is extended or adjusted under 35 U.S.C. 154(b) by 210 days.

(21) Appl. No.: 12/241,081

(22) Filed: Sep. 30, 2008

(65) Prior Publication Data

US 2009/0103285 A1 Apr. 23, 2009

(30) Foreign Application Priority Data

Oct. 19, 2007 (TW) ..... 96217576 U

(51) Int. Cl.
*F21V 33/00* (2006.01)

(52) U.S. Cl. ..... 362/101; 362/109; 362/276

(58) Field of Classification Search ..... 362/101, 362/96, 109, 577, 562, 184, 186, 276, 295, 362/394, 806, 809, 811
See application file for complete search history.

(56) References Cited

U.S. PATENT DOCUMENTS 4,858,083 A * 8/1989 Wakimoto ..... 362/101
4,967,321 A * 10/1990 Cimock ..... 362/101
5,105,343 A * 4/1992 Wakimoto ..... 362/101
5,165,781 A * 11/1992 Orak ..... 362/186
6,612,712 B2 * 9/2003 Nepil ..... 362/101
6,641,280 B2 * 11/2003 Hanson et al. ..... 362/186
6,712,683 B2 * 3/2004 Brandstetter ..... 451/550
6,796,671 B2 * 9/2004 Rudell et al. ..... 362/101
6,811,279 B2 * 11/2004 Coleman et al. ..... 362/101

* cited by examiner

*Primary Examiner*—Bao Q Truong
(74) *Attorney, Agent, or Firm*—Leong C. Lei

(57) ABSTRACT

An optoelectronic handhold includes a light-transmitting light emission portion and also has a touch control module, which includes a micro-switch for activating a power source to drive operation of an illuminator. A connection base includes a hollow structure having an end receiving therein the touch control module and coupled to the light-transmitting light emission portion and an opposite end forming a mounting portion for coupling with other structures for firm positioning. When a pull is applied to the handhold, the micro-switch is actuated to have the touch control module activating the illuminator to give off light traveling to and through the light-transmitting light emission portion for providing decoration.

9 Claims, 4 Drawing Sheets

STRUCTURE OF OPTOELECTRONIC HANDHOLD

TECHNICAL FIELD OF THE INVENTION

The present invention generally relates to a structure of an optoelectronic handhold, and particularly to a decorative handhold that can be mounted to other structures and effect lighting decoration through minute action that induces conduction of a power source to give off light.

DESCRIPTION OF THE PRIOR ART

Closets, desks, and organization cabinets are commonly used household furniture, which provides spaces for storage of articles. Such spaces are delimited by an outer frame or enclosure to which decorations are often provided. It is often that a handhold, such as a handle or a knob, is provided on these pieces of furniture for pulling to expose the storage space in order to deposit/remove articles into/out of the space. Such a handhold is a small piece of article, occupying only a very minute area of the furniture, but often provides an important role of aesthetics of the furniture.

Conventional designs of the handhold are often initiated in consideration of the mechanical strength for carrying a pulling force, or matching with a configuration of the overall structure of a closet. Thus, the most available handholds in the market are of a configuration of for example a handle or a spherical knob or a curved shape, which is often of a practical consideration, rather than aesthetic or fancy one. Apparently, a large gap to be filled is still present in the field of handhold designing.

Based on years' experience in development and manufacturing of decorative articles, the present applicant wishes to provide a handhold that, besides functioning as a handhold, provides a lighting effect and allows variation of the configuration thereof for matching, in a decorative sense, with other decorations. With successive attempts in the development of such a device, an optoelectronic handhold is invented and will be further described hereinafter.

SUMMARY OF THE INVENTION

Thus, the present invention provides an optoelectronic handhold, which generally comprises a light-transmitting light emission portion to which a touch control module is coupled in a corresponding manner. The touch control module comprises a micro-switch that is employed to selectively actuate a power source to drive operation of an illuminator. Also provided is a connection base that is a hollow structure having an end receiving the touch control module therein and coupled to the light-transmitting light emission portion and an opposite end forming a mounting portion for coupling with other decorative structures for firm positioning of the handhold. When a pull is applied to the handhold, the micro-switch is actuated to have the touch control module activating the illuminator to give off light traveling to and through the light-transmitting light emission portion for providing and/or enhancing decoration.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
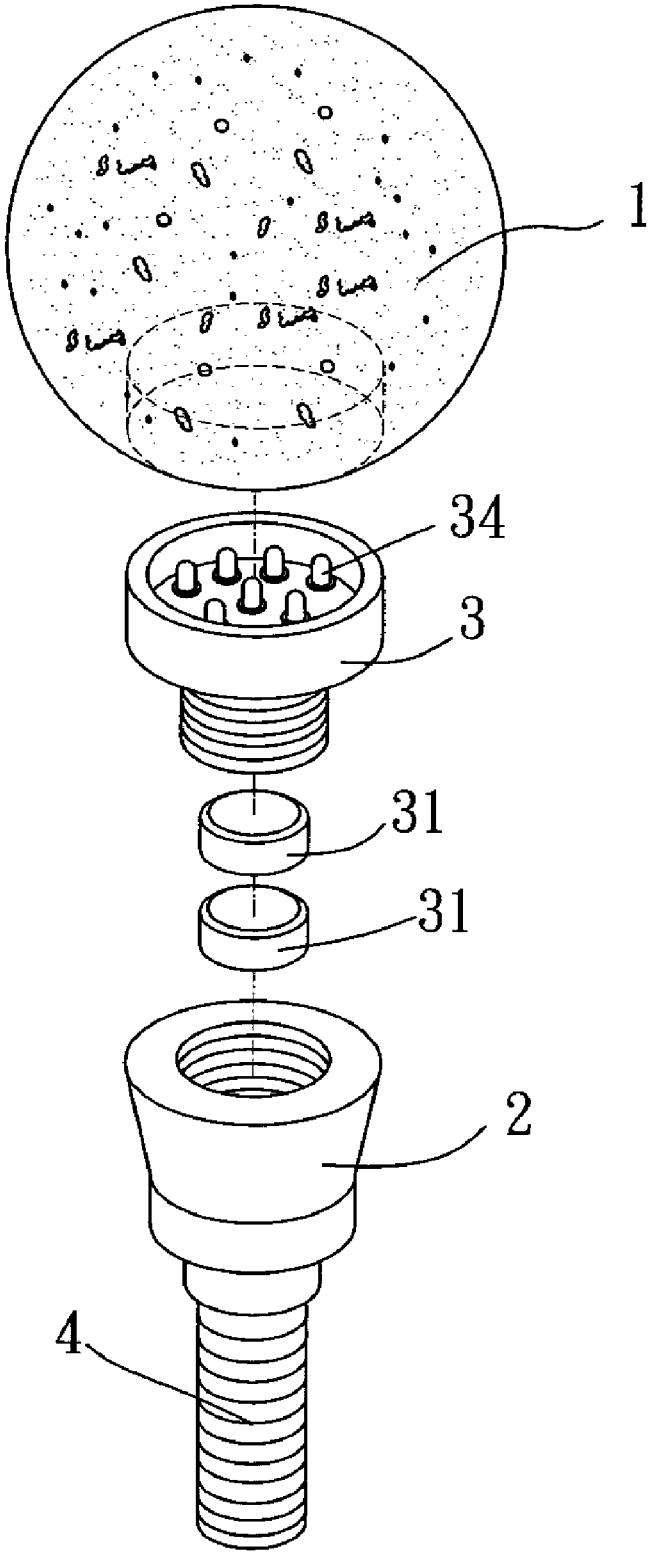
FIG. 1 is an exploded view of an optoelectronic handhold in accordance with the present invention.

With initial reference to FIG. 1, which illustrates an exploded view of an optoelectronic handhold constructed in accordance with the present invention, the optoelectronic handhold of the present invention comprises a light-transmitting light emission portion 1, a touch control module 3, a connection base 2, and a mounting seat 4.

The light-transmitting light emission portion 1 has a three-dimensional configuration in the outside appearance and is made light transmittable. The light-transmitting light emission portion 1 is also made hollow and contains therein a flowable liquid. If desired, the flowable liquid may be mixed with flake- or particle-like spangles. The three-dimensional configuration of the light-transmitting light emission portion 1 can be of a structure or shape facilitating hand holding by a user for pulling, such as a handle or a knob.

Figure 2:
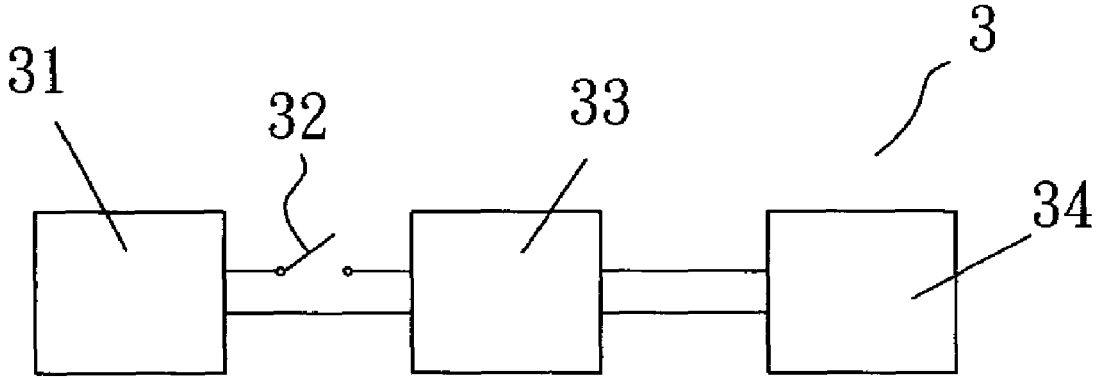
FIG. 2 is a schematic view illustrating a touch control module of the optoelectronic handhold of the present invention.

Also referring to FIG. 2, the touch control module 3 comprises a structure that embeds and retains therein a power source 31, a micro-switch 32, a control unit 33, and at least one illuminator 34. The touch control module 3 is arranged inside the light-transmitting light emission portion 1. To reduce the overall size, the power source 3 can comprise for example one or more mercury cells. The micro-switch 32 functions to detect slight vibration for conducting on and an example is a mercury switch. The control unit 33 is designed for intermittent or selective activation. The illuminator 34 can be any light generation device or element, such as a light-emitting diode, which is arranged in a direction facing the light-transmitting light emission portion 1.

The connection base 2 comprises a hollow structure having an open end receiving therein the touch control module 3.

The mounting seat 4 is configured to couple to, preferably form in an integral manner with, an opposite end of the connection base 2 and provides a connection with other decoration or structure to ensure firm positioning.

As such, when a pull is applied, the micro-switch 32 is caused to turn on the touch control module 3 that in turn activates the illuminator 34 to generate and give off light, and the light from the illuminator 34 travels to and through the light-transmitting light emission portion 1 to provide aesthetic and decorative effect.

Figure 3:
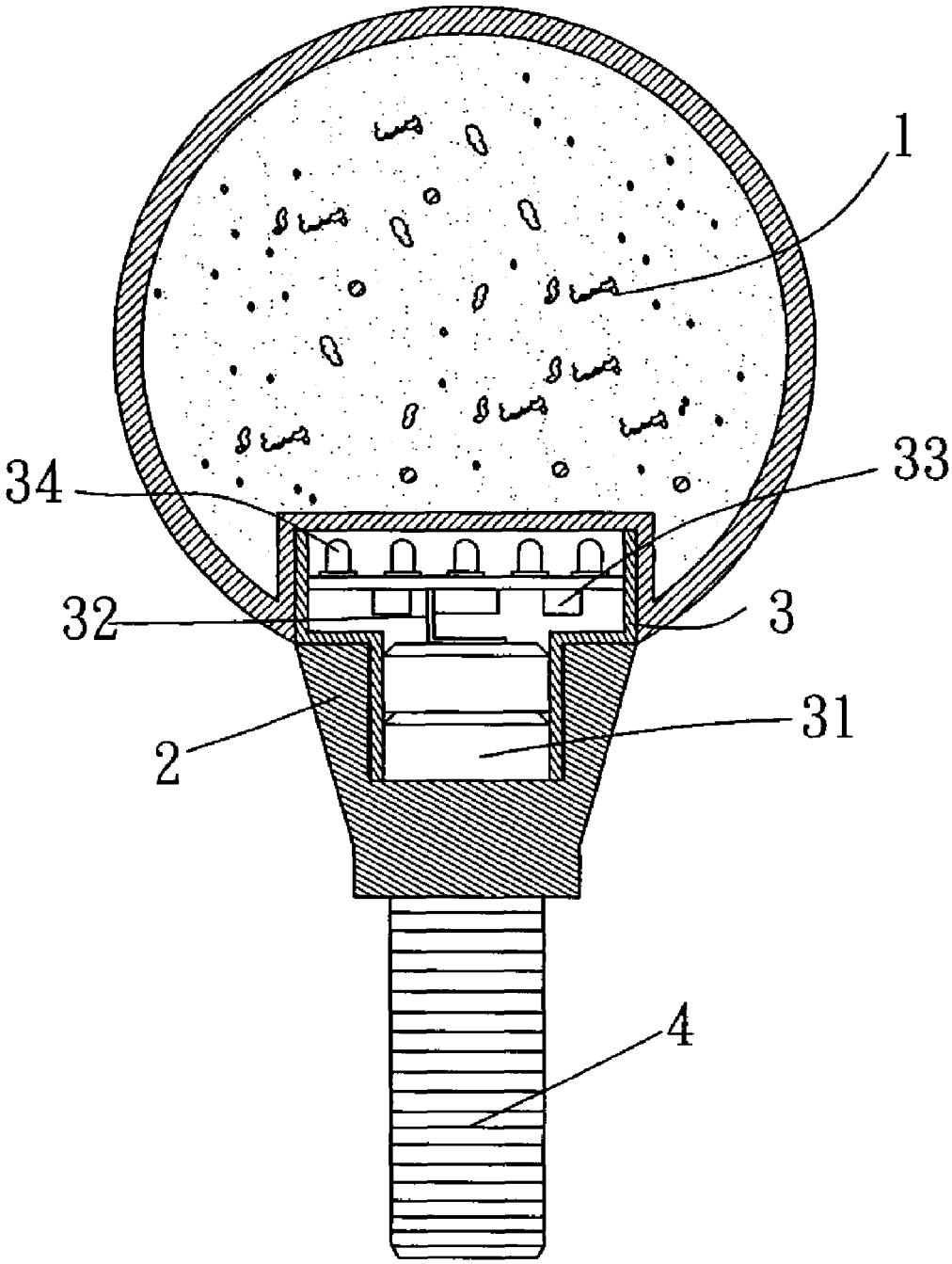
FIG. 3 is a cross-sectional view of the optoelectronic handhold of the present invention in an assembled form.
Figure 4:
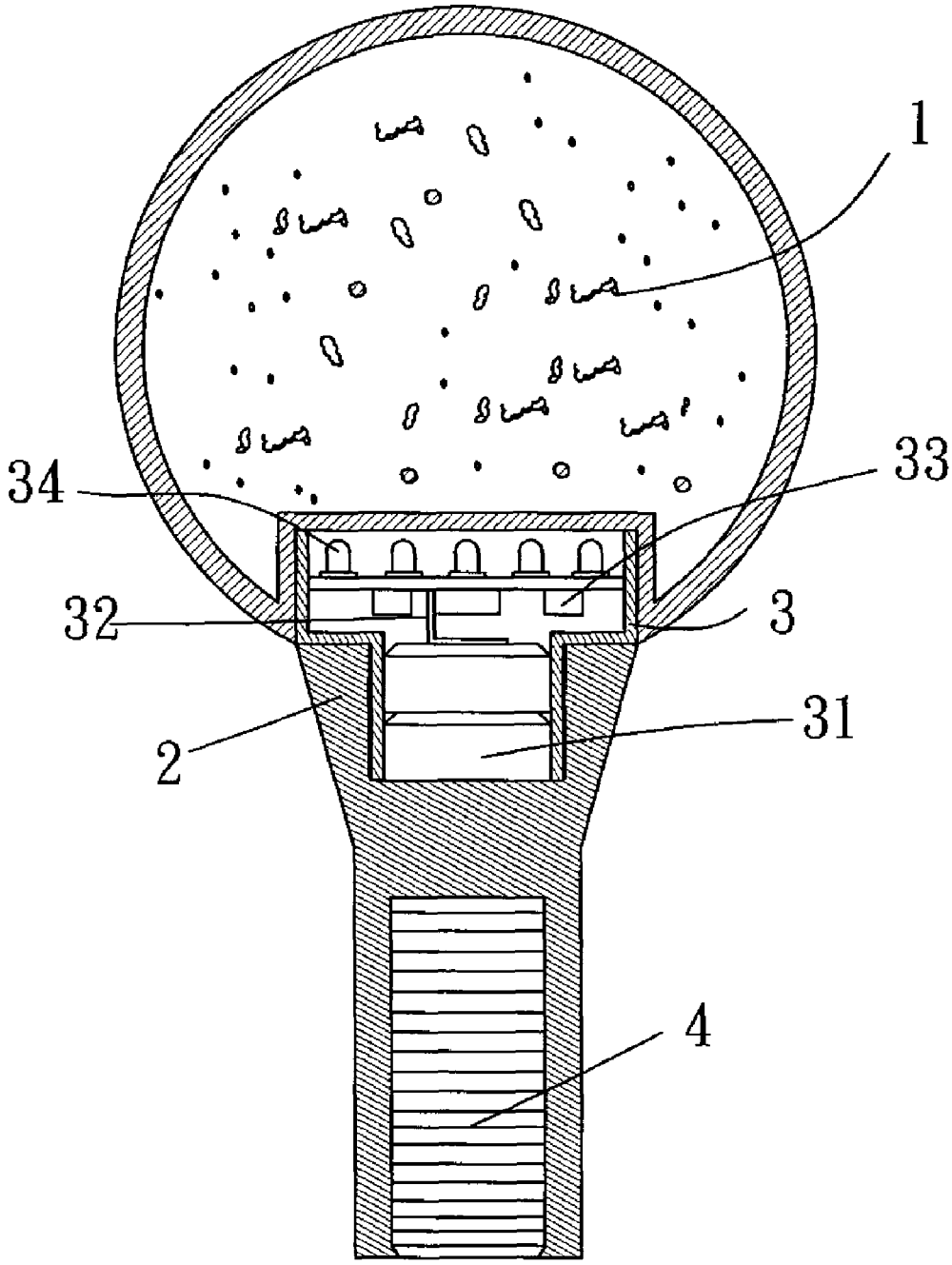
FIG. 4 is a cross-sectional view of the optoelectronic handhold of the present invention in accordance with a different embodiment in an assembled form.

Further referring to FIGS. 3 and 4, to assemble, the light source 31, the micro-switch 32, the control unit 33, and the illuminator 34 are first fit into the touch control module 3 and the so assembled touch control module 3 is then set in the light-transmitting light emission portion 1, which contains therein a liquid of low flowability, in such a way that the illuminator 34 is directed toward the light-transmitting light emission portion 1. The connection base 2 is then coupled to an end portion of the touch control module 3 that is exposed outside the light-transmitting emission portion 1 in such a way that the connection base 2 covers the touch control module 3 and lies against an outer surface of the light-transmitting light emission portion 1. The mounting seat 4 that is coupled to or integrally formed with the opposite end of the connection base 2 is formed with an external thread (FIG. 3) or an internal thread (FIG. 4) for readily coupling with other decorations or structures. With the mounting seat 4 mounted to other decoration and properly positioned, when a user contacts and pulls the light-transmitting light emission portion 1 of the present invention, a slight pulling force applied thereto causes the micro-switch 32 of the touch control module 3 to activate the control unit 33 and the illuminator 34, which may lead to for example an intermittent activation of predetermined seconds or other desired time periods, so that light is given off from the illuminator 34 and travels the light-transmitting light emission portion 1 to induce a dazzling/flashing effect. Alternatively, the light from the illuminator 34 can certainly be set in such a way that it is completely shut down after a given lapse of time, such as several seconds, and is then re-activated to give off light when the user touches or pulls the handhold of the present invention again.

From the above description of the constituent parts and operation of the optoelectronic handhold of the present invention, several advantages can be recognized and will be briefed as follows:

The optoelectronic handhold of the present invention uses a touch control module that incorporates a micro-switch so that a slight vibration or action applied to the handhold is sufficient to effectively activate the illuminator to give off light. Thus, the design of a handhold can be made versatile and flexible and decoration can also be realized with such a handhold.

To conclude, the above description of the integral formation of the structure in accordance with the embodiment of the present invention reveals that the present invention does perfectly exhibit the decorative characteristics of the liquid-contained lighting device and that the present invention provides an effect of dazzling/flashing of light through the operation of the illuminator by means of the activation of the touch control module so that a more vivid and dynamic feeling is realized through the flowability of the liquid contained in the liquid-contained lighting device.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An optoelectronic handhold, comprising a light emission portion, a connection base, a touch control module, and a mounting portion, wherein:

the light emission portion comprises a three-dimensionally configured and light transmitting structure forming a container containing therein a flowable liquid;

the touch control module comprises a structure that contains therein a power source selectively actuated by a micro-switch to activate operation of an illuminator;

the connection base comprises a hollow structure having an end receiving therein the touch control module and coupled to the light emission portion; and the mounting portion is formed on an opposite end of the connection base and is adapted to couple to an external structure for firm positioning;

whereby when a vibration is caused by applying a pull to the light emission portion, the micro-switch is caused to have the touch control module activating the illuminator so that the illuminator gives off light that is allowed to travel to and through the light emission portion to provide a decorative effect.

2. The optoelectronic handhold according to claim 1, wherein the light emission portion contains therein a liquid of low flowability.

3. The optoelectronic handhold according to claim 1, wherein the flowable liquid contained in the light emission portion contains flake-like spangles.

4. The optoelectronic handhold according to claim 1, wherein the flowable liquid contained in the light emission portion contains particle-like spangles.

5. The optoelectronic handhold according to claim 1, wherein the touch control module comprises a control unit that control the operation of the illuminator.

6. The optoelectronic handhold according to claim 1, wherein the illuminator of the touch control module comprises a light-emitting diode.

7. The optoelectronic handhold according to claim 1, wherein the power source comprises a mercury cell.

8. The optoelectronic handhold according to claim 5, wherein the control unit controls the illuminator in an intermittent activation manner.

9. The optoelectronic handhold according to claim 5, wherein the control unit controls the illuminator in a selective activation manner.

* * * * *